US005152508A

United States Patent [19]

Fish

[11] Patent Number: 5,152,508

[45] Date of Patent: Oct. 6, 1992

[54] SAFETY BARRIER

[76] Inventor: Robert E. Fish, 34460 Bermont Rd., Punta Gorda, Fla. 33982

[21] Appl. No.: 858,334

[22] Filed: Mar. 26, 1992

[51] Int. Cl.[5] ..... E04H 17/16

[52] U.S. Cl. ..... 256/24; 403/23; 403/73; 340/550

[58] Field of Search ..... 256/23, 25, 24, 10, 256/73; 49/13, 14; 340/550, 541

[56] References Cited

U.S. PATENT DOCUMENTS 3,810,146 5/1974 Lieb ..... 340/541
4,380,327 4/1983 Fish ..... 256/24
5,102,103 4/1992 Putnam ..... 256/25 X

*Primary Examiner*—Andrew V. Kundrat
*Attorney, Agent, or Firm*—Charles J. Prescott

[57] ABSTRACT

A removable safety barrier erectable around the perimeter of a swimming pool or the like including a plurality of upright barrier elements positionable end-to-end around the pool and an alarm arrangement for detecting relative movement between adjacent barrier elements as when a child attempts to enter the pool. Electrical connection between adjacent barrier elements for the alarm is automatically made each time the device is erected around the pool. Improved resistance to tearing, ripping or pulling the restraining mesh from support members is also provided.

6 Claims, 2 Drawing Sheets

SAFETY BARRIER

BACKGROUND OF THE INVENTION

This invention relates generally to safety barriers, and more particularly to a light weight safety barrier which can be easily removed and folded for storage for preventing children and others from reaching a swimming pool or other dangerous areas and which includes an alarm arrangement for signaling such an occurrence.

Reference is made to my previous U.S. Pat. No. 4,380,327 which is incorporated herein by reference, along with all other prior art references cited therein.

My previously patented invention provides a safety barrier which generally improves upon prior art by providing a light weight, waterproof barrier, particularly adapted for swimming pools, which can easily be deployed or removed by one person and is foldable into a compact storage position when not in use. However, improvements over my previous invention have now be invented by me.

One such improvement resides in the strength of the attachment of each mesh barrier panel between upright support members. The present invention also, in addition to providing superior strength in this connection, also provides an alarm arrangement for signaling any intrusion or encroachment upon the safety barrier, when installed.

BRIEF SUMMARY OF THE INVENTION

This invention is directed to a removable safety barrier erectable around the perimeter of a swimming pool or the like including a plurality of upright barrier elements positionable end-to-end around the pool and an alarm arrangement for detecting relative movement between adjacent barrier elements as when a child attempts to enter the pool. Electrical connection between adjacent barrier elements for the alarm is automatically made each time the device is erected around the pool. Improved resistance to tearing, ripping or pulling the restraining mesh from support members is also provided.

It is therefore an object of this invention to provide an improved light weight safety barrier for surrounding the perimeter of a swimming pool or other dangerous areas and for activating an alarm, either audible or visible, which will warn of intrusion or encroachment against the safety barrier.

It is another object of this invention to provide an improved light weight safety barrier for dangerous areas which may be easily deployed and stored by one person.

It is another object of this invention to provide an improved safety barrier for the perimeter of a swimming pool or other dangerous areas for improved strength for preventing unauthorized use or entry into the pool.

In accordance with these and other objects which will become apparent hereinafter, the instant invention will now be described with reference to the accompanying drawings.

DETAILED DESCRIPTION OF THE INVENTION

Figure 1:
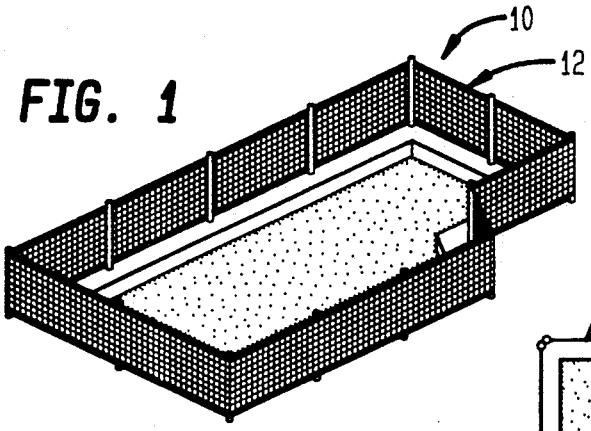
FIG. 1 is a perspective view of the invention disposed about the perimeter of a pool.
Figure 2:
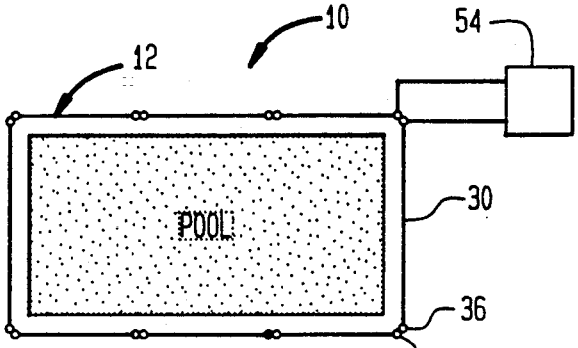
FIG. 2 is a top plan schematic view of FIG. 1.
Figure 3:
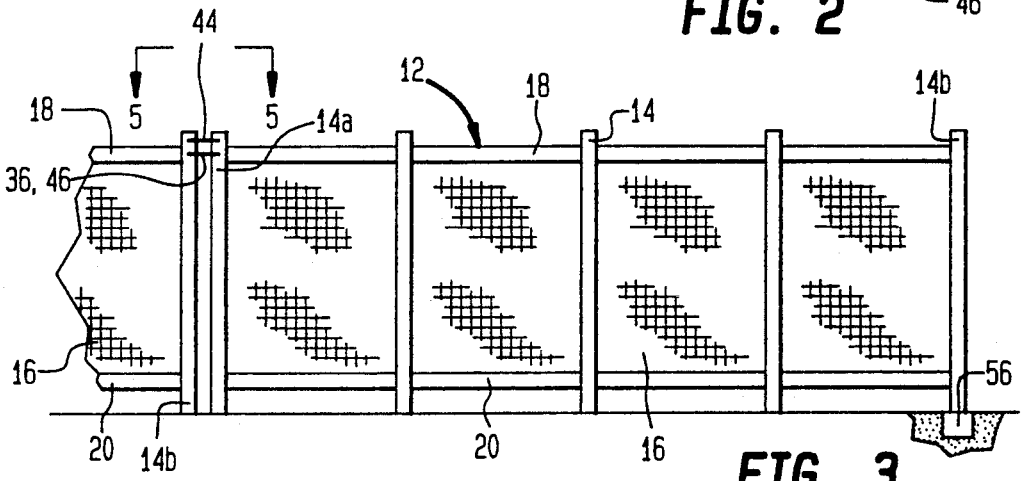
FIG. 3 is a front elevation view of one barrier element of the invention.

Referring now to the drawings, and particularly to FIGS. 1 and 2, the preferred embodiment of the invention is there shown at numeral 10 and includes a plurality of barrier elements 12 connected around the perimeter of the pool in side-by-side relationship so as to form a complete safety barrier 10 as shown.

In FIG. 2, as will be described more completely herebelow, each barrier element 12 includes a flexible electrical conduit or wire 30 connected along the length thereof and in electrical communication with an electrical contact 36 and 46 at each end thereof. By this arrangement, a completed electrical circuit is formed completely around the perimeter of the pool. An alarm 54, which may be audible or visible, is interconnected between any two contacts 36/46 so as to provide either an audible or viewable indicia of intrusion or encroachment upon the safety barrier 12.

Referring additionally to FIGS. 3 to 6, each barrier element 12 is constructed having a plurality of upright support members 14 formed of non-corrosive tubular aluminum which will be supportively received into tubular sleeves 56 embedded in the concrete or tile deck forming the perimeter around the pool.

Spanning between each upright support member 14 is a flexible mesh restraining panel 16 preferably constructed of poly coated weather resistant nylon in a screen pattern as illustrated. Each reastraining panel 16 includes a vinyl reinforcing strip 18 and 20 along its upper and lower margin to increase the strength of each restraining panel 16.

Encased within the upper reinforcing strip 18 is a dual conductor electrical conduit 30 which extends along the entire length thereof. Stitching along 52 and 58 secures this arrangement. This electrical wire 30 extends beyond one end at **30*a* from the reinforcing strip 18 and beyond the other end thereof at 30*b*. Note that the electrical conduit may alternately be similarly encased within lower reinforcing strip 20** as well.

Figure 4:
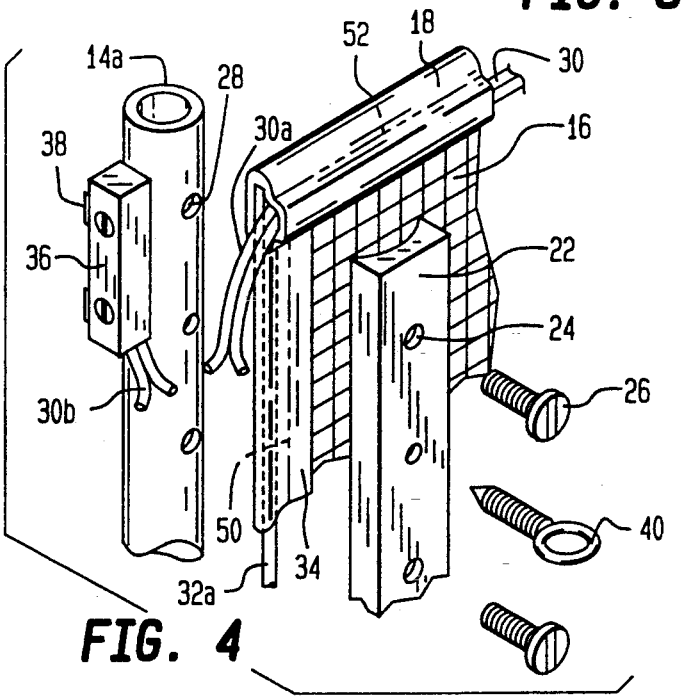
FIG. 4 is an enlarged partial exploded view of a mesh restraining panel connection with an end support member in accordance with the present invention.

Each restraining panel 16 is attached to each upright support member 14 as shown typically in FIG. 4 wherein an elongated aluminum mounting bar 22 is bolted by non-corrosive fasteners 26 into threaded holes 28 to each upright support member 14 with the restraining panels 16 tightly sandwiched therebetween.

Figure 5:
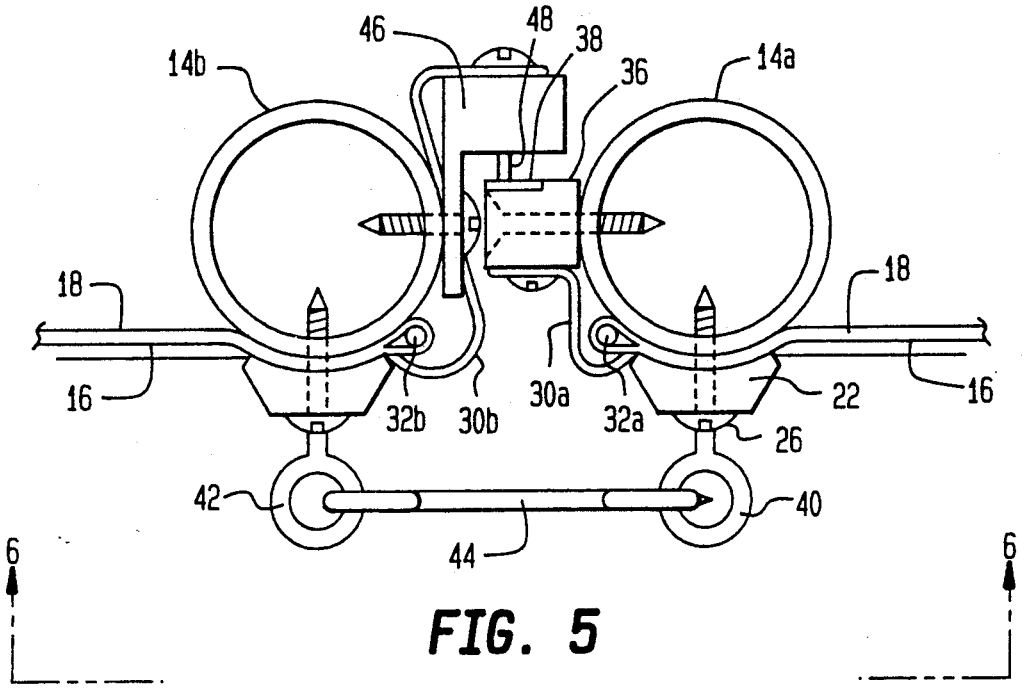
FIG. 5 is an enlarged partial view in the direction of arrows 5—5 in FIG. 3.

However, the attachment of the restraining panel 16 at each end of support member **14*a* and 14*b* typically requires additional strength to prevent pulling or dislodging the fabric restraining panel 16 from between the mounting bar 22 and the corresponding support member 14*a* or 14*b*. To accomplish this, in addition to a vinyl reinforcing strip connected along each upright end margin of restraining panel 16, a length of rope or bead material 32*a* is encased along the distal upright margin of each reinforcing strip 34. Stitching along 50 serves to further define the enlargement produced by rope 32*a* such that, as best seen in FIG. 5, an enlarged obstruction is created which positively prevents the pulling of the restraining panel 16 from between support members 14***a* and 14*b* and the mounting bar 22. This is so even if fasteners 26 are either improperly tightened or become loosened.

Figure 6:
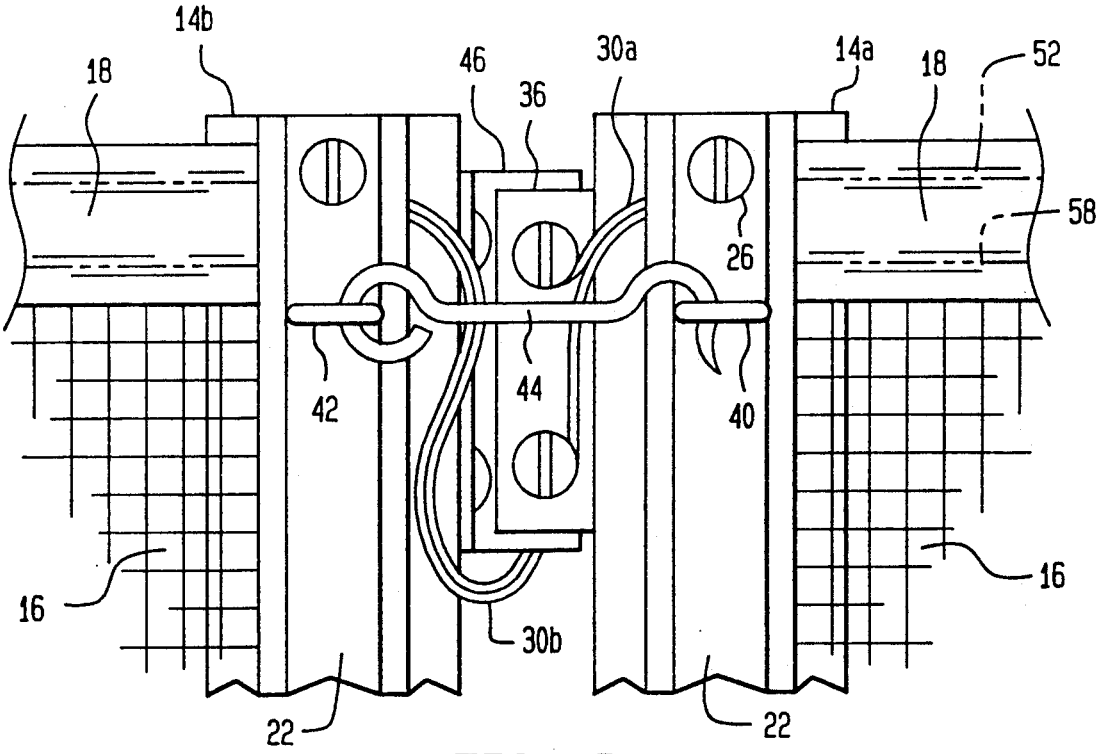
FIG. 6 is a view in the direction of arrows 6—6 in FIG. 5.

Also connected by non-corrosive threaded fastener to the upper end of each end support member 14*a* or 14*b* are mating electrical contacts 36 and 46, respectively, as best seen in FIGS. 4, 5 and 6. The ends 30*a* and 30*b* of electrical wire 30 are operably connected to these electrical contacts 36 and 46, respectively. By this arrangement, when the end support members 14*a* and 14*b* are positioned in upright position in close proximity to one another as shown in FIGS. 5 and 6, spring biased contact blade 48 electrically contacts against electrical contacts 38 so that a completed circuit is made between the wires 30 contained within side-by-side barrier elements 12.

So as to assist in maintaining the physical relationship between adjacent support members 14*a* and 14*b* as previously described, a conventional latch 44 threadably connected at one end by eye screw 42 to support member 14*b* operably engages into eye screw 40 connected into support member 14*a*. By this arrangement, the physical relationship shown in FIGS. 5 and 6 is, in conjunction with securing the lower ends of support members 14*a* and 14*b* engaged within sleeves 56 as previously described, serve to maintain this physical relationship.

However, should an intruder or inadvertent contact be made against any portion of any barrier element 12, electrical contact between contact switches 36 and 46 is broken. In such event, alarm 54 is activated as previously described.

While the instant invention has been shown and described herein in what are conceived to be the most practical and preferred embodiments, it is recognized that departures may be made therefrom within the scope of the invention, which is therefore not to be limited to the details disclosed therein, but is to be afforded the full scope of the claims so as to embrace any and all equivalent apparatus and articles.

What is claimed is:

1. A removable safety barrier for a swimming pool comprising:

a plurality of barrier elements, each of said barrier elements including a plurality of spaced apart, rigid slender upright support members and a flexible mesh restraining panel connected between each two adjacent said support members;

a flexible electrical wire connected to and extending along one horizontal margin of each said restraining panel;

said electrical wire in electrical communication between matable electrical contacts connected to each support member positioned at each end of said barrier element;

a completed electrical circuit being defined by said plurality of said electrical wires when said plurality of said barrier elements are positioned side-by-side around the perimeter of the swimming pool, said electrical contact at one end of each said barrier element being in electrical contact with said electrical contact at the opposite end of the adjacent said barrier element;

means for sensing and activating an alarm when said completed electrical circuit is broken.

2. A safety barrier as set forth in claim 1, further comprising:

an elongated mounting bar connected to and generally coextensive with each said support members structured for holding said restraining panel therebetween;

each upright end margin of each said restraining panel including a reinforcing strip connected therealong and encasing a rope therebetween;

each said rope acting against the corresponding said mounting bar to prevent said restraining panel from being pulled from between said support member and said mounting bar.

3. A safety barrier as set forth in claim 2, further comprising:

latch means connectable between the upper ends of said support members of adjacent said barrier elements.

4. A removable safety barrier for a swimming pool comprising:

a plurality of barrier elements, each of said barrier elements including a plurality of spaced apart rigid slender support members connectable in upright orientation around the perimeter of the swimming pool and a flexible mesh restraining panel connected between each two adjacent said support members;

electrical means for sensing and activating an alarm whenever any two adjacent said support members positioned at an end of any two correspondingly adjacent said barrier elements are moved relative to one another more than a predetermined distance.

5. A safety barrier as set forth in claim 4, further comprising:

an elongated mounting bar connected to and generally coextensive with each said support members structured for holding said restraining panel therebetween;

each upright end margin of each said restraining panel including a reinforcing strip connected therealong and encasing a rope therebetween;

each said rope acting against the corresponding said mounting bar to prevent said restraining panel from being pulled from between said support member and said mounting bar.

6. A safety barrier as set forth in claim 5, further comprising:

latch means connectable between the upper ends of said support members of adjacent said barrier elements.

* * * * *